US006834469B2

(12) United States Patent
Fingerson et al.

(10) Patent No.: US 6,834,469 B2
(45) Date of Patent: Dec. 28, 2004

(54) UTILITY LINE SUPPORT MEMBER

(75) Inventors: Conrad F. Fingerson, Chatfield, MN (US); Bruce F Blumentritt, Rochester, MN (US)

(73) Assignee: Geotek, Inc., Stewartville, MN (US)

( * ) Notice: Subject to any disclaimer, the term of this patent is extended or adjusted under 35 U.S.C. 154(b) by 110 days.

(21) Appl. No.: 09/768,398

(22) Filed: Jan. 24, 2001

(65) Prior Publication Data

US 2002/0095904 A1 Jul. 25, 2002

(51) Int. Cl.[7] ..... E04H 12/00

(52) U.S. Cl. ..... 52/651.02; 52/736.2; 52/40; 52/309.11

(58) Field of Search ..... 52/736.2, 730.4, 52/731.2, 732.1, 309.11, 787.1, 40, 697, 651.01, 651.02, 177, 181, 309.5, 309.7; 404/6; 446/123

(56) References Cited

U.S. PATENT DOCUMENTS

| | | | | | |
|---|---|---|---|---|---|
| 839,272 | A | | 12/1906 | Crow | |
| 857,938 | A | | 6/1907 | Harrison | |
| 1,123,342 | A | | 1/1915 | Megahan | |
| 1,815,598 | A | | 7/1931 | Stroup | |
| 1,835,243 | A | | 12/1931 | Schaffert | |
| 1,846,682 | A | | 2/1932 | Hammel | |
| 2,318,396 | A | * | 5/1943 | Hoyt | 174/45 R |
| 2,870,793 | A | | 1/1959 | Bailey | |
| 3,083,796 | A | | 4/1963 | Bell, Jr. | |
| 3,235,652 | A | | 2/1966 | Lindsey | |
| 3,268,191 | A | | 8/1966 | Bridges et al. | |
| 3,362,737 | A | | 1/1968 | Cobb | |
| 3,509,678 | A | | 5/1970 | Dake | |
| 3,555,747 | A | | 1/1971 | Taylor | |
| 3,603,717 | A | | 9/1971 | Scott | |
| 3,649,740 | A | | 3/1972 | Boyer et al. | |
| 3,653,622 | A | | 4/1972 | Farmer | |
| 3,715,460 | A | | 2/1973 | Elliott et al. | |
| 3,747,777 | A | * | 7/1973 | Kane | 211/193 |
| 3,813,837 | A | | 6/1974 | McClain et al. | |
| 3,884,442 | A | | 5/1975 | Breeden et al. | |
| 3,911,548 | A | | 10/1975 | Perry | |
| 4,246,732 | A | | 1/1981 | Frehner | |
| 4,262,047 | A | | 4/1981 | Barnett et al. | |
| 4,312,162 | A | | 1/1982 | Medney | |
| 4,435,242 | A | | 3/1984 | McNulty | |
| 4,559,262 | A | | 12/1985 | Cogswell et al. | |
| 4,682,747 | A | | 7/1987 | King, Jr. et al. | |
| 4,705,425 | A | | 11/1987 | Okawa | |
| 4,728,749 | A | | 3/1988 | Knight | |
| 4,742,661 | A | | 5/1988 | Burtelson | |
| 4,803,819 | A | | 2/1989 | Kelsey | |
| 4,878,984 | A | | 11/1989 | Bourrieres | |
| 4,934,861 | A | | 6/1990 | Weeks et al. | |
| 4,939,037 | A | | 7/1990 | Zion et al. | |
| 4,981,735 | A | | 1/1991 | Rickson | |
| 5,009,734 | A | | 4/1991 | Therond | |
| 5,013,512 | A | | 5/1991 | Malmstrom | |
| 5,093,957 | A | | 3/1992 | Do | |
| 5,247,774 | A | | 9/1993 | Johnson | |
| 5,259,660 | A | * | 11/1993 | Haesters | 296/195 |
| 5,505,036 | A | | 4/1996 | Wiles | |
| 5,605,017 | A | | 2/1997 | Fingerson et al. | |
| 5,775,035 | A | * | 7/1998 | Papin | 52/100 |
| 5,980,174 | A | | 11/1999 | Gallagher et al. | |
| 6,189,285 | B1 | * | 2/2001 | Mockry | 52/720.1 |
| 6,347,488 | B1 | * | 2/2002 | Koye | 52/40 |
| 6,367,226 | B1 | * | 4/2002 | Shauf et al. | 52/736.2 |

OTHER PUBLICATIONS

Richard J. Lewis, Hawley's Condensed Chemical Dictionary, 1997, John Wiley & Sons, 13$^{th}$ edition, p. 888.*

* cited by examiner

*Primary Examiner*—Naoko Slack
(74) *Attorney, Agent, or Firm*—Merchant & Gould P.C.

(57) ABSTRACT

A utility line support beam resists compressive forces while preventing moisture from entering the interior of the beam. A reinforcing member is placed within the interior of the beam. The reinforcing member is positioned to absorb any compressive forces resulting from either mounting the beam on a utility pole or mounting other structures to the beam. The beam is sealed to prevent moisture from entering.

17 Claims, 5 Drawing Sheets

UTILITY LINE SUPPORT MEMBER

TECHNICAL FIELD

The invention relates generally to utility line support members and relates more specifically to a hollow composite support member configured as a tangent crossarm or deadend.

BACKGROUND

Utility lines are typically supported by a crossarm mounted horizontally on a utility or "telephone" pole. Crossarms are of two general types; tangent crossarms and deadend crossarms. Tangent crossarms (frequently referred to simply as crossarms) are used to support the generally vertically downward load resulting from the weight of the utility lines. Typically, a utility line is supported by an insulator which in turn is connected to the crossarm.

Deadend crossarms (often-times referred to simply as deadends) are used to support generally horizontal loads in order to retain tension in the utility line. Typically, the utility line is attached to an insulator that in turn is horizontally connected to the deadend. A single deadend can be used at a terminal end, while a pair of deadends can be utilized adjacent to one another on a single utility pole in order to maintain tension in two different directions. In the latter configuration, jumper lines are frequently used to electrically connect the utility lines attached to the two deadends. Most commonly, deadends are used when it is necessary to make turns in the utility line, although deadends are periodically used within a straight run to maintain utility line tension.

Traditionally, most crossarms and deadends have been made of wood, typically either Douglas Fir or Southern Yellow Pine, although some are manufactured from either steel or aluminum. Unfortunately, wood support beams do suffer from several disadvantages. The most obvious problem is the weatherability (or lack thereof) of wood beams. Although wood beams can be treated to improve their weatherability, they still tend to rot over time, thereby requiring replacement. This is especially true in warmer and more humid climates such as the southern United States, where the typical service life of a wood beam is a fraction of that in colder climates.

Because wood is a natural, variable product, crossarms and deadends made from wood can suffer from variations in important performance parameters such as strength due to defects and variations in the grain structure and density of the wood. Moreover, wood beams tend to lose strength as they begin to rot. This can lead to premature failure of the beam. The frequency with which wood beams must be replaced due to excessive or premature weathering leads to a number of problems, including increased labor costs, disposal costs and the risk of injury to linemen.

Another concern with wood beams involves conductivity. Unfortunately, wood is a relatively poor electrical insulator, especially when damp. This results both in losses due to electricity traveling through the beam and down the utility pole, as well as possibly posing a risk to utility linemen. For example, if a lineman touches a hot electrical line and a wood beam, he or she could be electrocuted because the wood beam (especially if wet) could provide a ground. Metal support beams suffer from similar disadvantages, such as weatherability problems due to corrosion and the fact that metal support beams are highly conductive to electricity.

Fiberglass reinforced composite support beams, which can be pultruded or extruded, solve many of the problems associated with wood and metal beams. Fiberglass beams have a high strength to weight ratio and are very good electrical insulators. If treated with a coating that protects the fiberglass from ultraviolet light, fiberglass beams can last as much as five to ten times as long as a comparable wood beam. Moreover, the strength of a fiberglass beam remains relatively constant over the life of the beam, while the strength of a wood beam steadily declines. Fiberglass beams can be manufactured at a cost that compares favorably to wood or metal beams. Further, fiberglass beams are generally immune to insect damage.

Fiberglass beams are not without problems, however. One problem relates to moisture entering the beam and acting as an electrical conductor. This can cause arcing, which is a concern both because of the potential for electrical power outage as well as linemen safety. Another difficulty associated with fiberglass beams involves the compressive damage or "crushing" that can occur when tightening mounting bolts or insulator bolts. This is especially a problem when the linemen are accustomed to mounting wood beams.

Prior attempts to resolve these problems include hollow pultruded beams that are filled with materials such as a polyurethane foam or blocks of polystyrene foam. Unfortunately, these designs may not completely prevent moisture from entering the interior of the beam, so arcing or power loss remain potential problems. Moreover, the foam provides minimal support to prevent compression damage. Adding the foam can also add significantly to the expense of manufacturing the beam.

U.S. Pat. No. 3,715,460 describes a deadend support beam that is a hollow fiberglass tube with metallic mounting members attached to opposite ends. The tube has very thick walls to provide sufficient strength against compression damage. This adds considerably to the expense and complexity involved in manufacturing the beam. It is unclear whether the metallic mounting members are sufficient in preventing moisture from accessing the interior of the beam, thereby possibly causing arcing.

U.S. Pat. No. 4,262,047 describes a support beam that has an outer covering bonded around a fiberglass honeycomb log having adjacent cells throughout the log. While this design reduces concerns over arcing and may provide sufficient strength to resist compression damage, this performance is achieved through a complex manufacturing process that is both difficult to accomplish and quite expensive.

U.S. Pat. No. 5,605,017 describes a hollow support beam having bushings that provide additional resistance to compressive forces. Cylindrical bushings are placed into holes drilled through the support beam and bear any compressive forces that result from either mounting the beam to a utility pole or from mounting other equipment or mounting apparatuses to the beam itself. Unfortunately, this requires rather large holes to be drilled through the beam, which weakens the beam to other forces.

A need remains for a utility line support beam that provides sufficient resistance to compressive forces while preventing moisture from entering the beam. A need remains for a simple, lost cost and easy to manufacture utility line support beam.

SUMMARY

The invention involves a utility line support beam that resists compressive forces while preventing moisture from entering the interior of the beam. In its simplest terms, the invention involves a reinforcing member placed within the interior of the beam. The reinforcing member is positioned to absorb any compressive forces resulting from either mounting the beam on a utility pole or mounting other structures to the beam, as well as forces in use due to factors such as wind and ice. The beam is sealed to prevent moisture from entering.

Accordingly, the invention is found in a utility line support structure that includes a hollow fiber reinforced beam that has a transverse hole extending therethrough. A hollow reinforcing member that has an inner diameter about the same as a diameter of the transverse hole is placed within the beam to coincide with the transverse hole. The reinforcing member has an outer diameter that is greater than the inner diameter of the reinforcing member and is positioned within the beam such that a bolt can be inserted through both the beam itself and the reinforcing member.

The invention is also found in a method of manufacturing a utility line support structure. The method includes pultruding a hollow fiber reinforced beam having a first end and a second end and forming a transverse through hole within the beam. A reinforcing member having an outer diameter greater than a diameter of the transverse hole is positioned within the beam in conjunction with the transverse hole. Finally, the reinforcing member is secured in place.

These and other advantages and features of novelty that characterize the invention are pointed out with particularity in the claims annexed hereto. However, for a better understanding of the invention and its advantages, reference should be made to the drawings that form a further part hereof, and to the accompanying descriptive matter in which there is illustrated and described preferred embodiments of the invention.

DETAILED DESCRIPTION

Turning now to the drawings, in which similar reference numbers are used to indicate similar elements in multiple drawings, there is shown a utility line support structure 10. The support structure 10 can be used as a tangent crossarm or as a deadhead. Alternatively, the support structure 10 can be employed as any other beam used to support utility lines, as described for example in U.S. Pat. No. 5,605,017, which is incorporated by reference herein.

Figure 1:
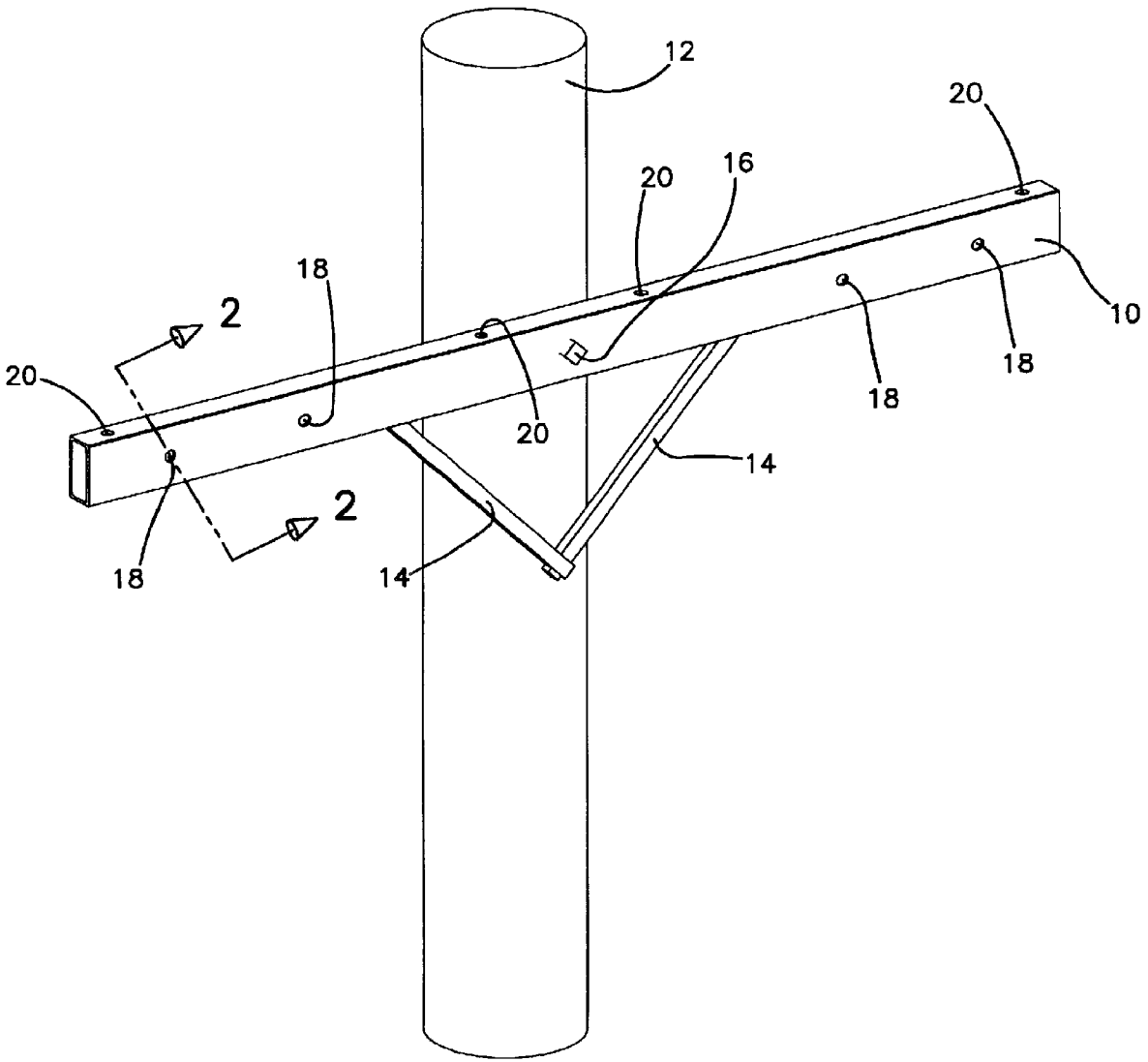
FIG. 1 is a perspective view of a utility pole bearing a utility line support structure in accordance with a preferred embodiment of the present invention.

FIG. 1 illustrates the support structure 10 in use in a preferred embodiment in which the support structure 10 is mounted to a utility pole 12. The support structure 10 is mounted to the utility pole 12 via mounting apparatus 16. Preferably, the support structure 10 is attached to the utility pole 12 and is supported by supports 14 as is well known in the art. The support structure 10 can be attached to the utility pole 12 in a variety of known ways, although it is preferred that the support structure 10 be bolted to the utility pole 12 using a reinforcing member 22 as described hereinafter.

As illustrated, the support structure 10 is a hollow pultruded beam of substantially rectangular cross-section. Preferably, the support structure 10 is formed with a rectangular cross-section, although other shapes such as annular, oval and various polygonal shapes can also be used. In a preferred embodiment, the support structure 10 has a rectangular cross-section that is about 11 centimeters by about 9 centimeters, with an average wall thickness of about 6 millimeters. Preferably, the inner and outer radiuses are about 5 millimeters and about 1.3 millimeters, respectively, thereby efficiently distributing stresses throughout the support structure 10. If the support structure 10 is rectangular in cross-section, it is preferred that any transverse holes be located so that they are approximately centered in any planar surface to optimize stress distribution.

In a particular embodiment, the support structure includes a plurality of transverse holes that traverse the beam in both horizontal and vertical directions. In this, horizontal and vertical are arbitrarily selected for discussion purposes and are not intended to necessarily refer to any subsequent orientation of the support structure 10 once mounted to a utility pole 12. As shown, the support structure 10 has several horizontal transverse holes 18 and several vertical transverse holes 20. The horizontal transverse holes 18 and the vertical transverse holes 20 can be used to mount insulators or other similar structures to the support structure 10, or to mount the support structure 10 to a utility pole.

Figure 2:
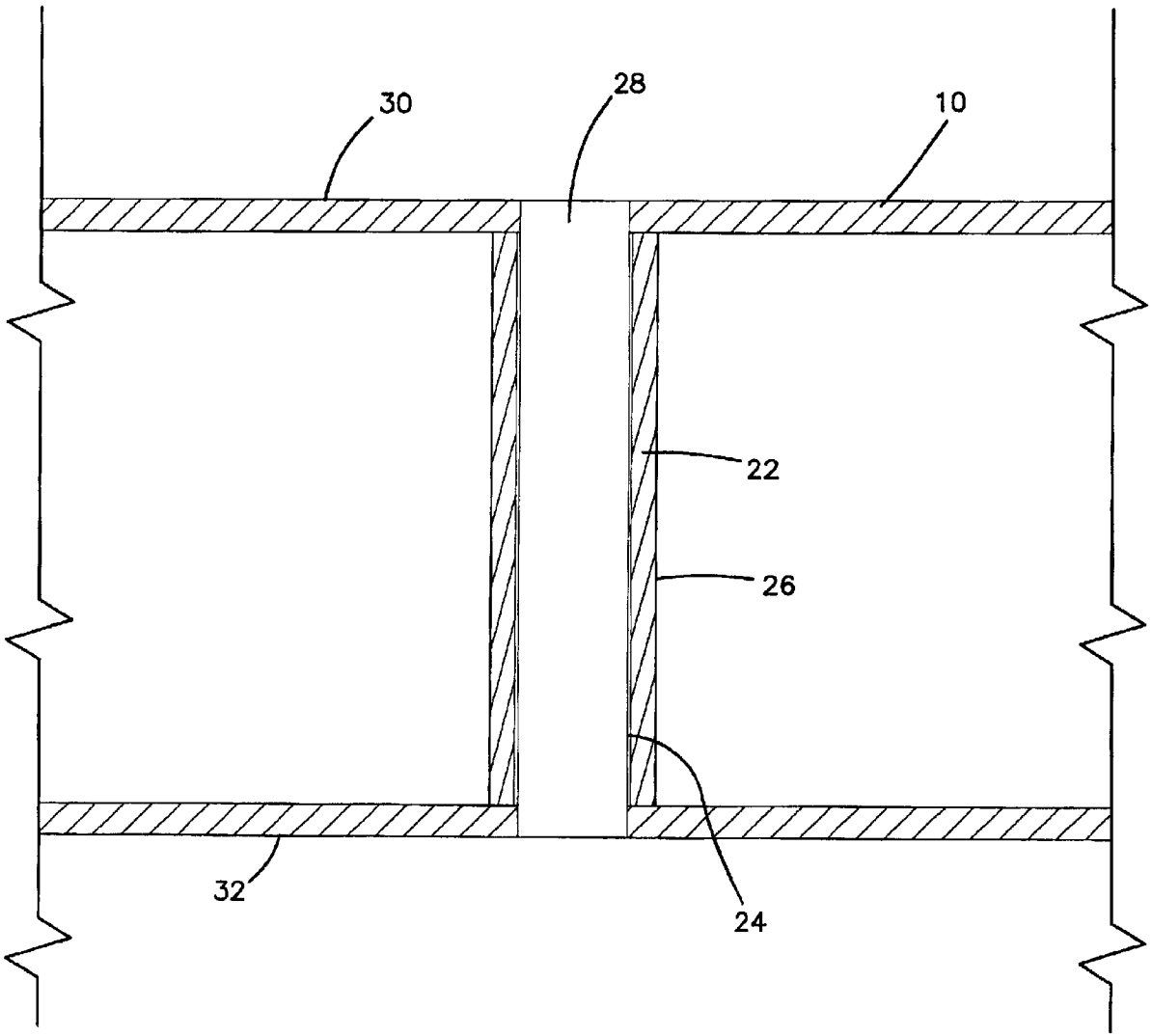
FIG. 2 is a cross-sectional view of the utility line support structure shown in FIG. 1, taken along the 2—2 line.

FIG. 2 is a cross-sectional view taken along the 2—2 line of FIG. 1, in which a transverse hole 28 is seen penetrating through the support structure 10 from a first exterior surface 30 to a second exterior surface 32. As illustrated, the transverse hole 28 corresponds to a horizontal transverse hole 18 as seen in FIG. 1, although the transverse hole 28 as illustrated corresponds equally to a vertical transverse hole 20. A reinforcing member 22 is positioned such that its interior surface 24 is aligned with the transverse hole 28.

In a preferred embodiment, the reinforcing member 22 is cylindrical in shape and has an inner diameter, defined by its interior surface 24, that is approximately equal to the diameter of the transverse hole 28. The reinforcing member 22 has an outer diameter, defined by its exterior surface 26, that is greater than the diameter of the transverse hole 28. The outer diameter of the reinforcing member 22 can be as large as necessary to provide a desired level of crush resistance and is limited in size only by the internal dimensions of the support structure 10.

Figure 3:
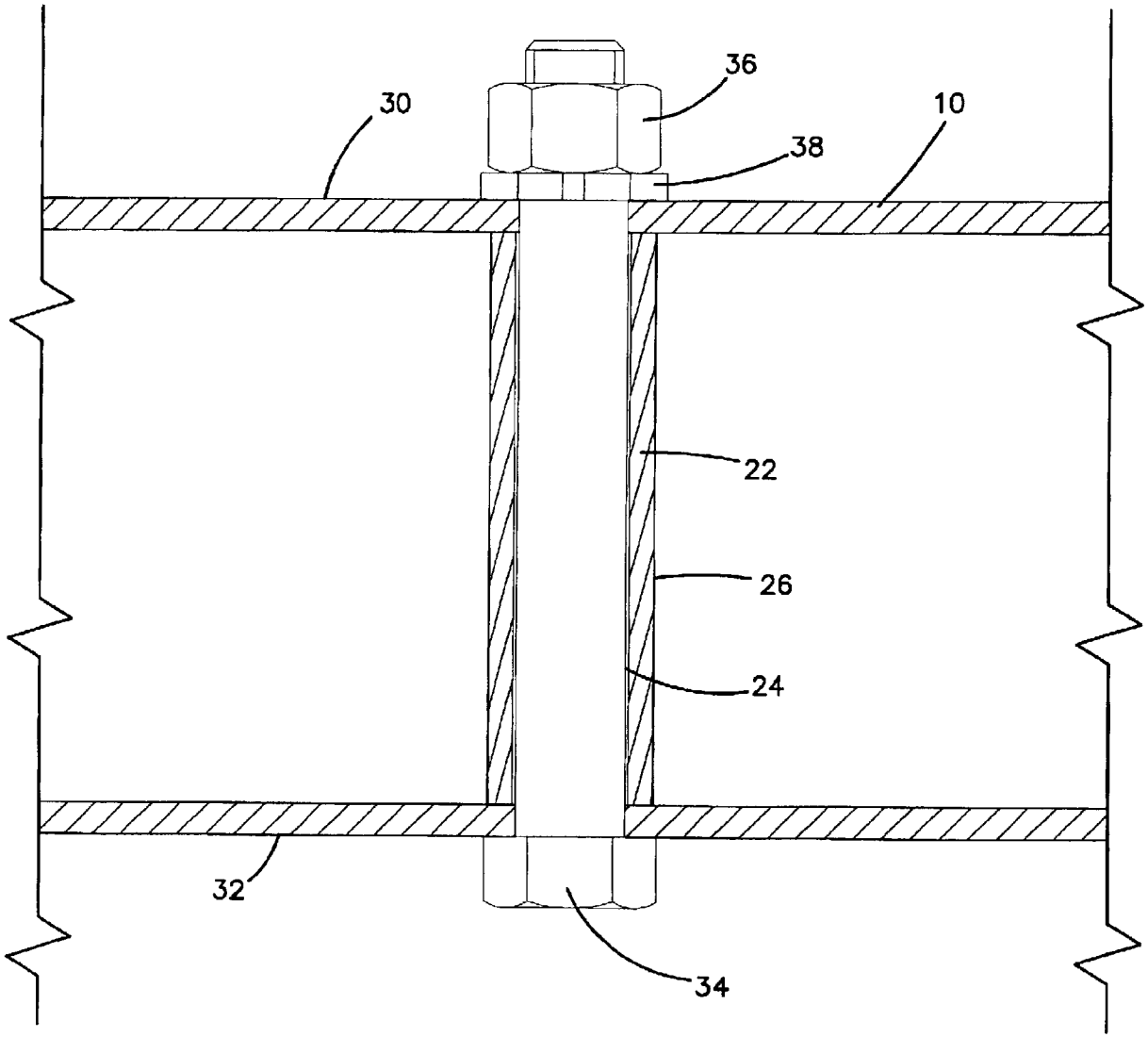
FIG. 3 is a diagrammatical cross-sectional view of a utility line support structure according to a preferred embodiment of the present invention.

The reinforcing member 22 is preferably sized to resist any crushing force that results from mounting bolt 34 as illustrated in FIG. 3. The mounting bolt 34 preferably has a diameter that is slightly smaller than the inner diameter of the reinforcing member 22. If the mounting bolt 34 is too large in diameter, the support structure 10 can be damaged by the resultant force necessary to drive the mounting bolt 34 through the support structure 10.

Alternatively, if the mounting bolt 34 has a diameter that is significantly smaller than the inner diameter of the reinforcing member, accurate positioning of any structure mounted to the support structure 10 can be compromised.

Moreover, if the mounting bolt 34 is sized such that it can move or rack within a transverse hole 28, additional stress can be placed on the support structure 10. Thus, the reinforcing member 22 preferably has an inner diameter that is no more than about 2.5 centimeters, each inner diameter preferably being about 0.16 centimeters greater than the diameter of the particular mounting bolt to be used. As bolts of varying sizes are often used, examples of preferred reinforcing members 22 include those having inner diameters of 1.4 centimeters, 1.7 centimeters, 2.1 centimeters and 2.4 centimeters. Preferably, the outer diameter of the reinforcing member 22 ranges from about 2.5 centimeters to about 5 centimeters.

The reinforcing member 22 is preferably designed to resist any forces resulting from the utility lines that are ultimately supported thereby. If the support structure 10 is used in a crossarm application (as seen in FIG. 1), these forces include the weight of the utility lines and forces such as wind and ice that act upon these lines. Preferably, the reinforcing member 22 has a length that is approximately equal to an inner dimension of the support structure 10. It is preferred that the reinforcing member 22 be easily positioned within the interior volume of the support structure 10 yet be long enough to provide a desired level of crush resistance.

The support structure 10 itself is preferably a pultruded part and is manufactured according to well known techniques. In pultrusion, rovings and mats consisting of glass fibers are pulled through a liquid resin and then through a die having a desired cross-section to impregnate and shape the reinforcing fibers into a cured product having a uniform cross-section.

In a preferred embodiment, about 1000 rovings, each having about 4000 glass fibers, and about 32 inches width of 1.5 ounce per square foot continuous strand mat are used. A high-performance, unsaturated polyester thermoset resin is most preferred, although one of skill in the art will recognize that other types of resins can also be utilized. These include vinyl esters, epoxies, and phenolics as well as a variety of thermoplastic resins.

Once the support structure 10 has been formed, any number of appropriate horizontal transverse holes 18 and vertical transverse holes 20 can be punched or drilled through the support structure 10. Preferably, these transverse holes 18, 20 are positioned to correspond to externally mounted structures such as insulators. Once the transverse holes are formed, a reinforcing member 22 is positioned within the support structure 10 to correspond to each transverse hole. Once positioned, the reinforcing members 22 are secured in place using a variety of suitable adhesives. Preferably, the adhesive bonds provide a moisture seal between the reinforcing member 22 and the support structure 10.

Figure 4:
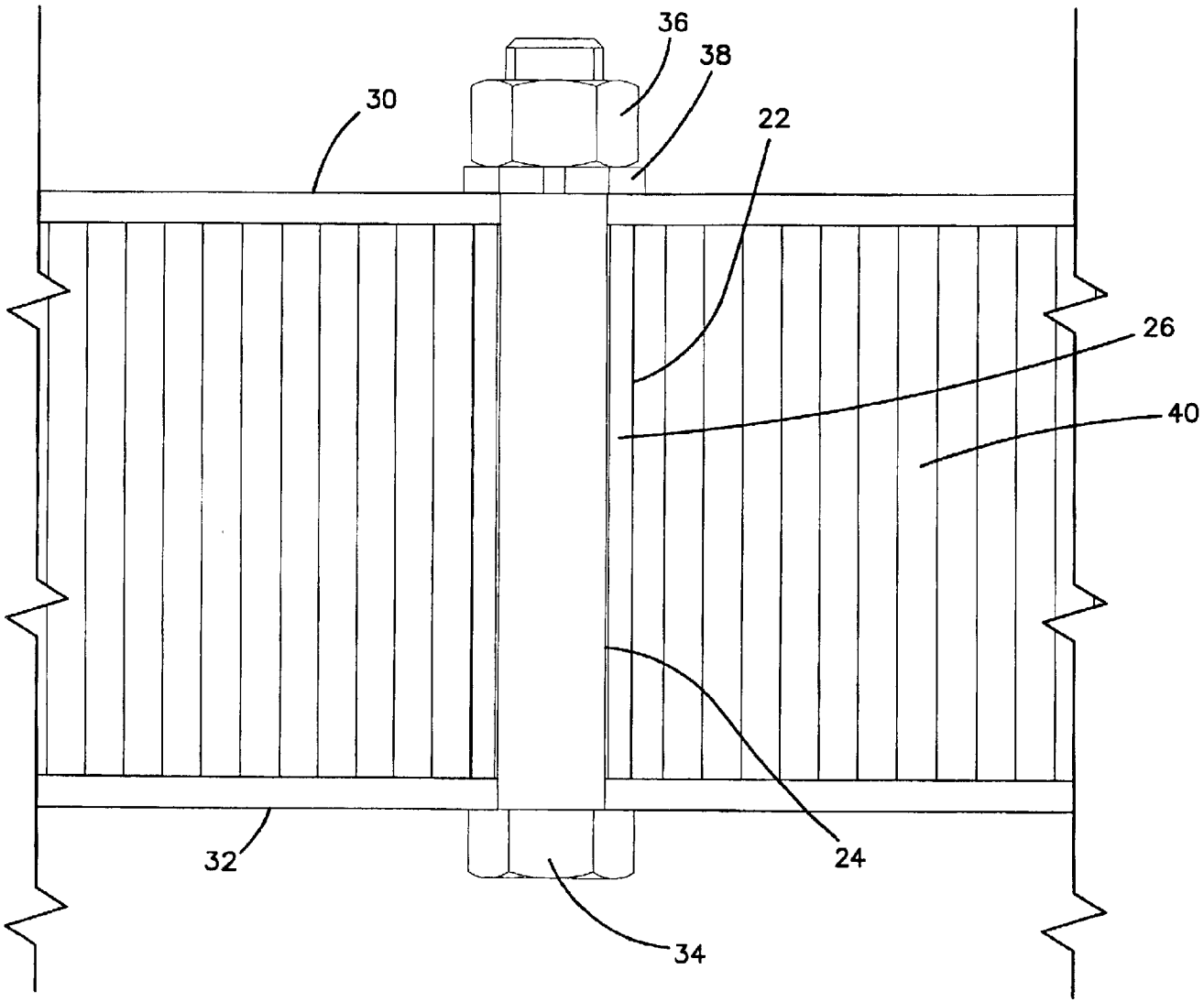
FIG. 4 is a diagrammatical cross-sectional view of a utility line support structure according to another preferred embodiment of the present invention.

Alternatively, the interior of the support structure 10 can be filled with a foam 40 (as seen in FIG. 4) that serves to hold the reinforcing members 22 in position. Preferably, the foam 40 also serves to minimize moisture migration into and through the support structure 10. A variety of different foams can be used, as known to those of skill in the art. A preferred foam is polyurethane.

Figure 5A:
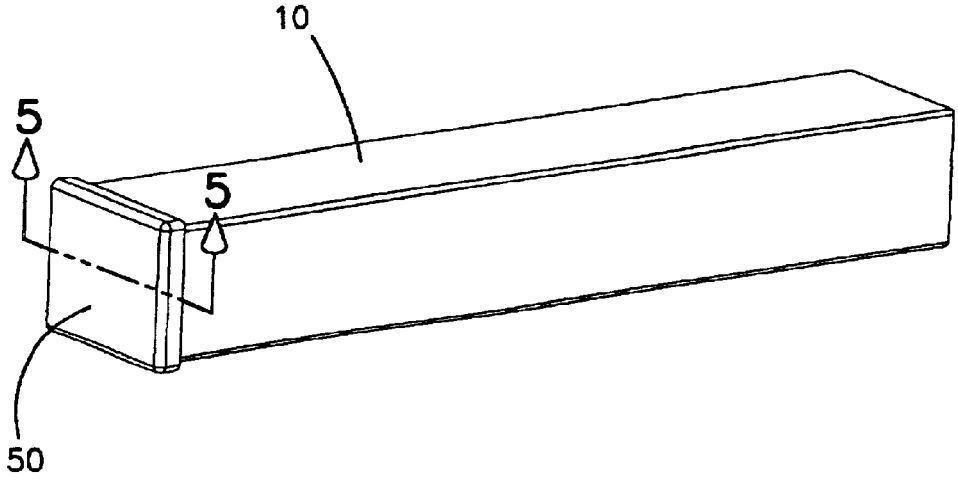
FIG. 5A is a perspective view of a utility line support structure in accordance with a preferred embodiment of the present invention, bearing an end cap.

To ensure that water is kept out of the interior of the support structure 10, end caps 50 are secured to either end, as seen for example in FIG. 5*a*. Suitable end caps are also described, for example, in U.S. Pat. No. 5,605,017, previously referenced. Preferably, the end caps 50 are configured such that they provide additional mechanical strength and crush resistance and help prevent damage to the ends of the support structure 10 during handling and installation. In a preferred embodiment, the end caps 50 are configured to capture the ends of the support structure 10 and support both the inner and outer edges of the support structure 10.

Figure 5B:
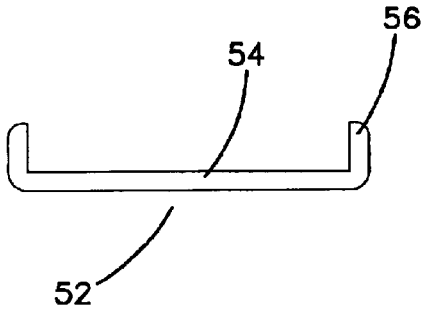
FIG. 5B is a cross-sectional view of the end cap of FIG. 5A, taken along the 5—5 line.

FIG. 5*b* is a cross-section of FIG. 5*a*, taken along the 5—5 line. FIG. 5*b* illustrates an end cap 52 that serves to cover an end of the support structure 10 and prevent moisture from entering the interior of the support structure 10. The end cap 52 includes a portion 54 that is sized and configured to seal the end of the support structure 10. Preferably, the portion 54 is flat or substantially planar, although other geometries can be employed as well. The end cap 52 also includes an extended portion 56 that preferably extends beyond the end of the support structure 10 once installed. The extended portion 56 can also provide a surface upon which various adhesives can be placed to secure the end cap 52 into position on the support structure 10.

Figure 5C:
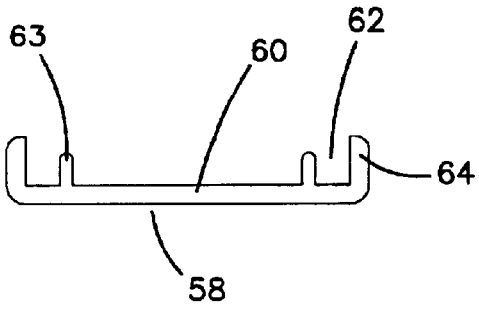
FIG. 5C is a diagrammatical cross-sectional view of another embodiment of the end cap of FIG. 5A.
Figure 5D:
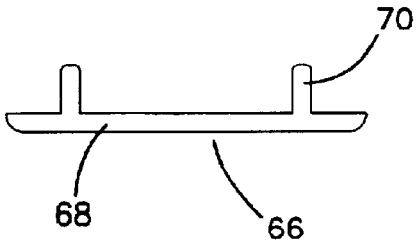
FIG. 5D is a diagrammatical cross-sectional view of another embodiment of the end cap of FIG. 5A.

FIGS. 5*c* and 5*d* are variations shown as diagrammatical cross-sections of FIG. 5*a*. In FIG. 5*c*, the end cap 58 is similar to the end cap 52 but is configured with an inner extended portion 63 and an outer extended portion 64 that cooperate to form slot 62. Preferably, an end of the support structure 10 fits into the slot 62. This provides a preferred embodiment, as the inner extended portion 63 and the outer extended portion 64 provides additional mechanical strength to the end of the support structure 10. Moreover, the inner and outer extended portions 63 and 64, respectively, provide additional surface to which adhesives can be applied.

FIG. 5*d* shows an end cap 66 that is similar to the end cap 58, except that the outer extended portion 64 have been removed. Instead, the end cap 66 has a planar surface 68 that is configured to seal an end of the support structure 10 and extended portions 70 that fit within an end of the support structure 10.

The outer surface of the support structure 10 is preferably coated with a weather-resistant coating to prevent surface degradation caused by exposure to sunlight. In a preferred embodiment, a high performance acrylic coating such as SUNGUARD II™ is applied to the beam through either spraying or an in-line coating procedure.

The above specification provides an enabling description of the manufacture and use of the invention. Since many embodiments of the invention can be made without departing from the spirit and scope of the invention, the invention resides in the claims hereinafter appended.

We claim:

1. A utility line support structure comprising:

a hollow fiber reinforced beam having a plurality of transverse holes extending therethrough; and a plurality of hollow reinforcing members placed in an interior of the beam, one hollow reinforcing member being aligned with each transverse hole, each reinforcing member having a first surface defining an inner diameter that is approximately the same as a diameter of the transverse hole with which the hollow reinforcing member is aligned and a second surface defining an outer diameter that is greater than said transverse hole diameter, the first and second surfaces both being disposed within the beam;

wherein each reinforcing member is positioned within the beam such that separate bolt can be inserted through each transverse hole of the beam and the reinforcing member aligned with each transverse hole.

2. The utility line support structure of claim 1, wherein the reinforcing members have a length sufficient to fit within a first interior wall and second, opposing, interior wall within the beam.

3. The utility line support structure of claim 1, wherein the reinforcing members are placed within the beam after the beam has been formed, the reinforcing members being slid into an open end of the beam and positioned in alignment with the transverse holes.

4. The utility line support structure of claim 1, wherein the inner diameter of the reinforcing members are less than or equal to about 2.5 centimeters.

5. The utility line support structure of claim 1, wherein the reinforcing members are selected from the group consisting of metal, plastic and a fiber reinforced composite material.

6. The utility line support structure of claim 1, wherein the reinforcing members comprise a fiber reinforced resin.

7. The utility line support structure of claim 1, wherein the reinforcing members are held in place with an adhesive forming a water tight seal between the reinforcing members and the beam.

8. The utility line support structure of claim 1, wherein the reinforcing members are held in place by filling the beam with a foam forming a water tight seal between the reinforcing members and the beam.

9. The utility line support structure of claim 1, further comprising an end cap.

10. The utility line support structure of claim 9, wherein the cap entraps an end of the support structure, thereby providing mechanical support to the support structure and preventing moisture from penetrating into the support structure.

11. The utility line support structure of claim 1, wherein the transverse holes and reinforcing members are used to secure the reinforced beam to a utility pole.

12. The utility line support structure of claim 1, wherein the transverse holes and reinforcing members are used to secure an insulator to the reinforced beam.

13. The utility line support structure of claim 1, wherein the reinforced beam has a rectangular cross-section having a first axis and a second axis, one of the reinforcing members being positioned along the first axis and configured to support one of the separate bolts used to mount the beam to a utility pole, and another one of the reinforcing members being positioned along the second axis and configured to support another of the separate bolts used to mount an insulator to the beam.

14. The utility line support structure of claim 1, wherein only one of the plurality of transverse holes extends through the beam at each longitudinal position along a length of the beam.

15. A utility line support structure comprising:

a hollow fiber reinforced beam having a transverse hole extending therethrough; and a hollow reinforcing member placed in an interior of the beam to coincide with the transverse hole, the reinforcing member having an inner diameter that is approximately the same as a diameter of the transverse hole and an outer diameter that is greater than said transverse hole diameter;

wherein the reinforcing member is positioned within the beam such that bolt can be inserted through both the beam and the reinforcing member and the reinforcing member is held in place by filling the beam with a foam.

16. A utility line support structure comprising:

a hollow fiber reinforced beam having a transverse hole extending therethrough; and a hollow reinforcing member placed in an interior of the beam to coincide with the transverse hole, the reinforcing member having an inner diameter that is approximately the same as a diameter of the transverse hole and an outer diameter that is greater than said transverse hole diameter;

wherein the reinforcing member is positioned within the beam such that a bolt can be inserted through both the beam and the reinforcing member, and the reinforcing member is held in place with an adhesive.

17. A utility line support structure comprising:

a plurality of hollow reinforcing members each having a first surface defining an inner diameter and a second surface defining an outer diameter; and a hollow fiber reinforced beam having a length extending between first and second ends of the beam, an interior volume, and a plurality of transverse holes extending through the beam at locations along the beam length, the transverse holes each having a diameter substantially the same as the inner diameter of the hollow reinforcing members, each transverse hole being the only transverse hole through the beam at each longitudinal position along the length of the beam, the beam being configured to receive the hollow reinforcing members within the beam in alignment with separate transverse holes.

* * * * *